United States Patent [19]

Crist, Jr.

[11] Patent Number: 4,924,092

[45] Date of Patent: May 8, 1990

[54] CORONA GENERATING SYSTEM

[75] Inventor: Buckley Crist, Jr., Wilmette, Ill.

[73] Assignee: Electro-Technic Products Company, Chicago, Ill.

[21] Appl. No.: 318,535

[22] Filed: Mar. 3, 1989

[51] Int. Cl.[5] ..... H01T 19/00

[52] U.S. Cl. ..... 250/324

[58] Field of Search ..... 250/324, 423 R, 344; 361/229, 230; 422/186.03, 186.04, 186.05, 907; 204/165, 312

[56] References Cited

U.S. PATENT DOCUMENTS

| | | | |
|---|---|---|---|
| 3,742,301 | 6/1973 | Burris | 361/230 |
| 3,779,882 | 12/1973 | Rosenthal | 204/165 |
| 3,813,547 | 5/1974 | Silverberg | 250/324 |
| 4,155,093 | 5/1979 | Fotland et al. | 361/230 |
| 4,693,869 | 9/1987 | Pfaff | 422/186.04 |

OTHER PUBLICATIONS

High Frequency Generator Testers, Electro-Technic Products, Inc., 4644 North Ravenswood Ave., Chicago, Ill. 60640 (312) 561-2349.

*Primary Examiner*—Janice A. Howell
*Assistant Examiner*—Kiet T. Nguyen
*Attorney, Agent, or Firm*—Lee, Mann, Smith, McWilliams & Sweeney

[57] ABSTRACT

A system for creating a uniform corona over a volume of free space. A high frequency electrical corona generator is connected to a first electrode having a corona driving element and a corona emitting element, with the corona driving element being greater in size than the corona emitting element such that corona is emitted from the corona emitting element in a direction away from the corona driving element. A second electrode, essentially identical to the first, is spaced from the first with its corona emitting element oriented toward the corona emitting element of the first electrode. A resonator coil is attached to the second electrode, the coil having resonant frequency the same as a resonant frequency of the corona generator and being situated within an electric field generated by the first electrode.

7 Claims, 1 Drawing Sheet

Fig. 1.
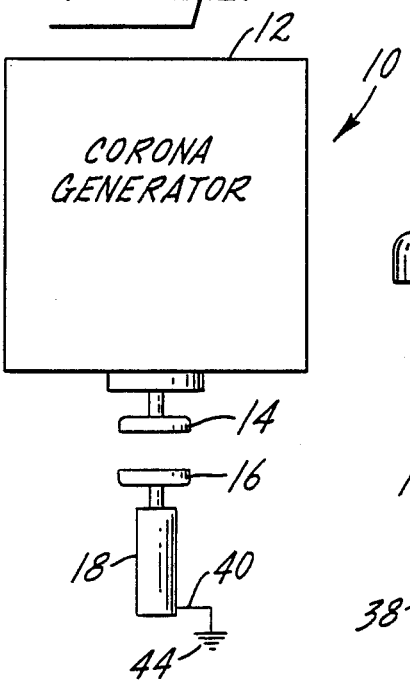
Fig. 2.
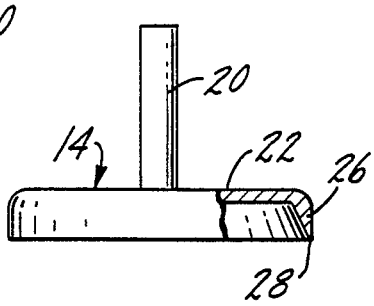
Fig. 3.
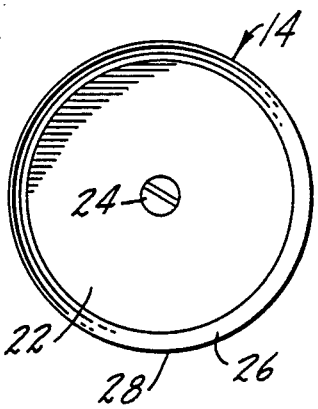
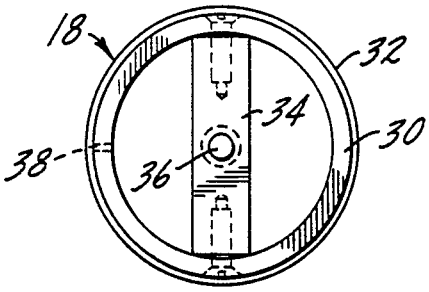
Fig. 6.
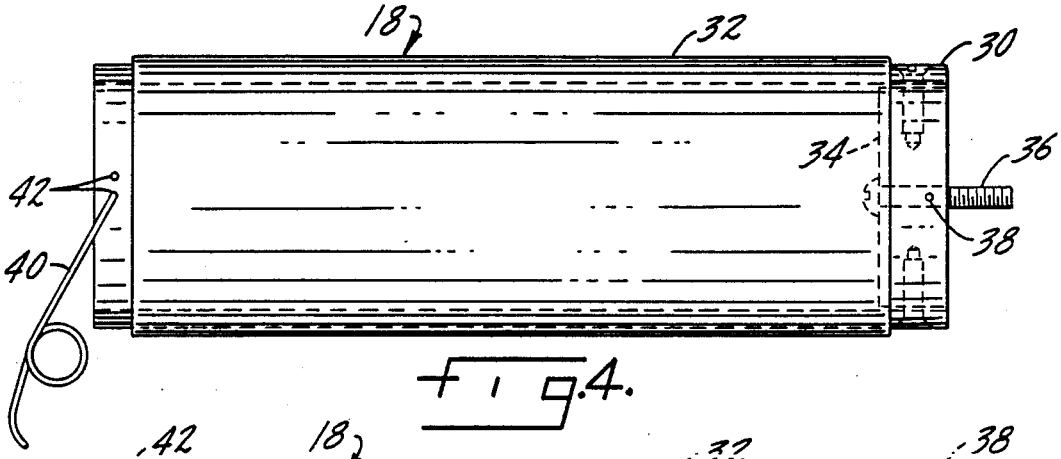
Fig. 4.
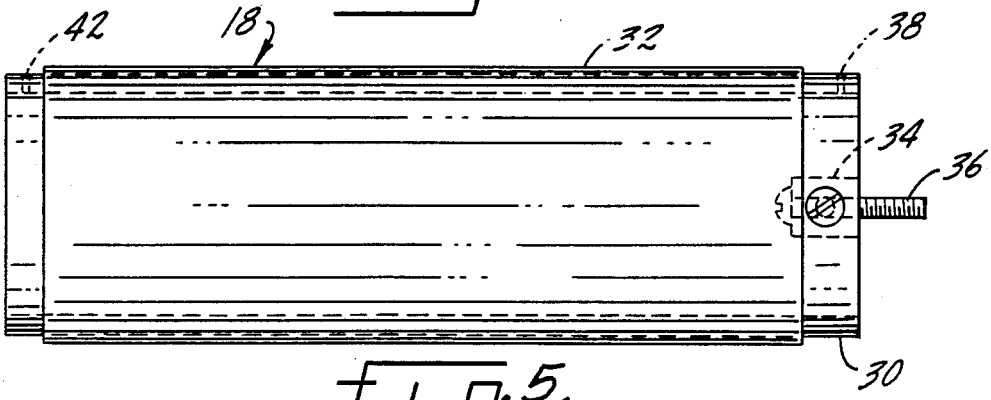
Fig. 5.

CORONA GENERATING SYSTEM

BACKGROUND OF THE INVENTION

This invention relates to surface treating of plastics and other materials, and in particular to a system for creating a corona between a pair of electrodes with only one of the electrodes being driven by a high frequency electrical corona generator.

As explained in U.S. Pat. No. 4,693,869, the disclosure of which is incorporated herein by reference, many plastics, when molded, will not accept an adhesive, a coating, or inks or printing vehicles unless the surface of the plastic has been chemically and/or physically altered. This patent discloses an electrode arrangement for creating a corona for treating such surfaces to accept adhesives, coatings, inks or other materials applied to the surface. While the corona treating arrangement is particularly useful for treating one side of a plastic, the system cannot treat both sides without the plastic material having been passed beneath the electrode arrangement once, and then being turned over and passed beneath the electrode arrangement again. Obviously, when large quantities of plastics are to be treated on all sides, this repeat process tends to be quite slow.

SUMMARY OF THE INVENTION

The present invention provides a unique system for creating a uniform corona over a predetermined volume of free space, so that a plastic or other material can be treated on all sides at one time. The system comprises a high frequency electrical corona generator which includes means for generating resonant frequencies on the order of two MHz and above, with a first electrode being attached to the corona generator. The first electrode has a first corona driving element and a first corona emitting element, with the corona driving element being greater in size than the corona emitting element such that corona is emitted from the corona emitting element is a direction away from the corona driving element. A second electrode is spaced from the first electrode, and has a second corona driving element and a second corona emitting element, with the second corona driving element being greater in size than the second corona emitting element such that corona is emitted from the second corona emitting element in a direction away therefrom. The second corona emitting element is oriented such that corona emitted from the second electrode is emitted in a direction toward the first electrode. A resonant coil has one end attached to the second electrode, and has a resonant frequency the same as a resonant frequency of the corona generator, and the coil is located within an electric field generated by the first electrode so that a high voltage is induced in the coil and a corona is emitted from the second electrode.

In accordance with the preferred form of the invention, the coil and the corona generator are connected to a common ground. The first and second electrodes are essentially identical so that a volume of uniform corona is created between the electrodes. Each corona driving element comprises a disc and each corona emitting element comprises a ring circumferentially secured to the disc.

BRIEF DESCRIPTION OF THE DRAWINGS

The invention is described in greater detail in the following description of an example embodying the best mode of the invention, taken in conjunction with the drawing figures, in which:

FIG. 1 is a schematic illustration of one form of the invention,

FIG. 2 is an enlarged view of a form of electrode used in FIG. 1, with the electrode partially in cross section to show internal structure, FIG. 3 is a bottom plan view of the electrode shown in FIG. 2, FIG. 4 is an enlarged plan view of a resonator coil used in the system of the invention, FIG. 5 is a plan view of the coil of FIG. 4, the view taken from the bottom in relation to FIG. 4, and FIG. 6 is a right side end view of the resonator coil of FIG. 4.

DESCRIPTION OF AN EXAMPLE EMBODYING THE BEST MODE OF THE INVENTION

A system for creating a uniform corona according to the invention is illustrated generally at 10 in FIG. 1. The system includes a corona generator 12, a pair of electrodes 14 and 16, and a resonator coil 18.

The corona generator 12 can be any readily available high voltage, high frequency corona generator, and is preferably the model BD-80 high frequency corona surface treater manufactured by Electro-Technic Products Company, Chicago, Ill. The BD-80 surface treater operates at 250 kv at a frequency of 2 MHz and above. As explained in patent number 4,693,869, in the operating parameters of the BD-80 surface treater, a corona is emitted downwardly from the electrode 14 without the necessity of any ground plane or grounding electrode for attracting the corona from the electrode 14.

The electrodes 14 and 16 are preferably identical to one another, and only the electrode 14 is described in any detail. As best shown in FIGS. 2 and 3, the electrode 14 is composed of a stem 20 attached to a disc-like corona driving element 22. As shown in FIG. 3, a bolt 24 passes through the corona driving element 22 and secures the stem 20 to the driving element 22.

A corona emitting element 26 in the form of an integral ring is located at the outer circumference of the driving element 22. The emitting element 26 is tapered to a tip or edge 28 from which corona is emitted. Corona is emitted from the edge 28 downwardly (in relation to FIG. 2) in a direction away from the corona driving element 22 in a ring like fashion due to the annular nature of the emitting element 26.

The electrodes 14 and 16 may be spaced from one another as appropriate. As the spacing increases, corona between the electrodes may become less uniform, but will be quite adequate for treating many plastics. Also, obviously, the electrodes 14 and 16 may be of other configurations, as treating needs dictate.

The resonator coil 18 is generally cylindrical in shape, being composed of an inner cylinder 30 of an inert material such as plastic, and an outer wire coil 32 wound thereabout. The windings of the coil 32 are not individually shown, and in accordance with the preferred embodiment of the invention, the coil 32 is composed of 225 turns of number 30 magnetic wire which are wound at a rate of 30 turns per lineal inch. One end of the cylinder 30 includes a crosswise support rod 34 which is bolted or otherwise secured to the interior of the cylinder 30, and which includes a central mounting screw 36 for mounting of the electrode 16 thereto. The screw 36 is of a conductive material, while the support rod 34 is of an insulative material, such as the same plastic as the cylinder 30.

The cylinder 30 also includes a small bore 38 through which a wire lead (not illustrated) extends from one end of the coil 32 to the mounting screw 36. The other end of the coil 32 is attached to a lead 40 which passes through a pair of small bores 42 before being attached to the opposite end of the coil 32 (attachment not illustrated).

When the resonator coil 18 is connected as illustrated in FIG. 1, one end of the wire coil 32 is attached via the screw 36 to the electrode 16. The other end of the coil 32 is attached to the lead 40 which is connected to a ground 44. Preferably, the ground 44 is the same ground as that for the corona generator 12.

When the system 10 is connected as illustrated in FIG. 1, when the corona generator 12 is activated, corona is emitted from the electrode 14. Also, the electrical field created by the electrode 14 induces a high voltage in the resonator coil 18, the coil 18 then activating the electrode 16 to emit a corona in the direction of the electrode 14. Emitted corona fills the volume between the electrodes 14 and 16, and therefore any material passed between the electrodes 14 and 16 will be treated on all sides, so long as the entire object to be treated is enveloped by the corona between the electrodes 14 and 16. The applicant has found the invention to be particularly suitable for treating the entire outer surfaces of bottles, tubs and similar items that can fit between the electrodes 14 and 16.

Various changes can be made to the invention without departing from the spirit thereof or scope of the following claims.

What is claimed is:

1. a system for creating a uniform corona over a predetermined volume of free space, comprising a. a high frequency electrical corona generator including means for generating resonant frequencies on the order of 2 MHz and above, b. a first electrode attached to said corona generator, said first electrode having a first corona driving element and a first corona emitting element, with the corona driving element being greater in size than the corona emitting element such that corona is emitted from the corona emitting element is a direction away from the corona driving element, c. a second electrode having a second corona driving element and a second corona emitting element, the second corona driving element being greater in size than the second corona emitting element such that corona is emitted from the second corona emitting element in a direction away therefrom, said second electrode being spaced from said first electrode and having said second corona emitting element oriented such that corona emitted from said second electrode is emitted in a direction toward said first electrode, and d. a resonator coil having one end attached to said second electrode, said resonator coil having a resonant frequency the same as a resonant frequency of said corona generator, said coil being located within an electric field generated by said first electrode.

2. A system according to claim 1 in which a second end of said coil is connected to a ground.

3. A system according to claim 2 in which said coil and said corona generator are connected to a common ground.

4. A system according to claim 1 in which said second electrode is essentially identical to said first electrode.

5. A system according to claim 4 in which each corona driving element comprises a disc and each corona emitting element comprises a ring circumferentially secured to said disc.

6. A system according to claim 5 in which said ring includes a taper to a corona emitting edge.

7. A system according to claim 5 in which said disc and said ring are integral.

* * * * *